US009097013B2

(12) United States Patent
Smith et al.

(10) Patent No.: US 9,097,013 B2
(45) **Date of Patent: *Aug. 4, 2015**

(54) FABRICATION MEMBER

(71) Applicant: KRIP LLC, Auburn, AL (US)

(72) Inventors: Jeremy Ryan Smith, Carrollton, VA (US); Kennon Whaley, Montgomery, AL (US)

(73) Assignee: Krip LLP, Auburn, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/067,437

(22) Filed: Oct. 30, 2013

(65) Prior Publication Data

US 2014/0053406 A1 Feb. 27, 2014

Related U.S. Application Data

(63) Continuation of application No. 13/936,438, filed on Jul. 8, 2013.

(60) Provisional application No. 61/680,773, filed on Aug. 8, 2012.

(51) Int. Cl.
*E04C 3/04* (2006.01)
*B21D 51/02* (2006.01)
(Continued)

(52) U.S. Cl.
CPC . *E04C 3/04* (2013.01); *B21D 47/04* (2013.01); *B21D 51/02* (2013.01); *E04C 3/07* (2013.01);
(Continued)

(58) Field of Classification Search
CPC ..... B21C 37/02; B21C 37/06; B21C 37/065; B21C 37/08; B21C 37/0803; B21C 37/15; E04C 3/29; E04C 3/04; B21D 51/02; B21D 5/16; B21D 47/04
USPC ..... 72/176, 177, 368; 29/33 B, 33 S, 897, 29/897.3, 897.31, 897.312
See application file for complete search history.

(56) References Cited

U.S. PATENT DOCUMENTS 3,469,067 A 9/1969 Ogden et al.
4,251,973 A 2/1981 Paik
(Continued)

FOREIGN PATENT DOCUMENTS

DE 3343709 A1 * 6/1984
WO 9322521 11/1993
(Continued)

OTHER PUBLICATIONS

R. Baumer et al., "Transient High-Frequency Welding Simulations of Dual-Phase Steels", Supplement to the Welding Journal, Oct. 2009, pp. 193-s-201-s.

*Primary Examiner* — Debra Sullivan
(74) *Attorney, Agent, or Firm* — Hahn Loeser & Parks LLP

(57) ABSTRACT

A method of making a composite fabrication member having a shape selected from the group consisting of C-shape, U-shape, or Z-shape by providing first and third planar members suitable to form bases of a composite fabrication member, providing a second planar member suitable to form a web of a composite fabrication member, uncoiling and passing through accumulators the planar members, aligning the planar members, attaching the first, second, and third planar members together at respective side portions by induction welding to form a composite intermediate product to form a composite fabrication member having a shape selected from the group consisting of C-shape, lipped C-shape, U-shape, lipped U-shape, Z-shape or lipped Z-shape.

21 Claims, 6 Drawing Sheets

(51) Int. Cl.
*B21D 47/04* (2006.01)
*E04C 3/07* (2006.01)

(52) U.S. Cl.
CPC . *E04C 2003/0413* (2013.01); *E04C 2003/0473* (2013.01); *E04C 2003/0482* (2013.01); *Y10T 29/49627* (2015.01)

(56) References Cited

U.S. PATENT DOCUMENTS

| | | | | |
|---|---|---|---|---|
| 5,163,225 | A | 11/1992 | Goleby | |
| 5,373,679 | A | 12/1994 | Goleby | |
| 5,403,986 | A | 4/1995 | Goleby | |
| 5,501,053 | A | 3/1996 | Goleby | |
| 5,600,932 | A | 2/1997 | Paik et al. | |
| 5,924,316 | A * | 7/1999 | Streubel et al. | 72/51 |
| 6,883,218 | B2 * | 4/2005 | Kibben et al. | 29/407.05 |
| 2008/0028720 | A1 | 2/2008 | Bartlett et al. | |
| 2008/0289390 | A1 | 11/2008 | Bartlett et al. | |
| 2008/0290140 | A1 | 11/2008 | Bartlett et al. | |
| 2011/0162320 | A1 | 7/2011 | Bartlett et al. | |
| 2012/0073343 | A1 * | 3/2012 | Prehn | 72/51 |

FOREIGN PATENT DOCUMENTS

| | | |
|---|---|---|
| WO | 9621535 | 7/1996 |
| WO | 9630606 | 10/1996 |
| WO | 2006068657 | 6/2006 |

* cited by examiner

FABRICATION MEMBER

This application is a continuation of and claims priority to U.S. patent application Ser. No. 13/936,438 filed Jul. 8, 2013, currently pending, which claims priority to U.S. Provisional Patent Application No. 61/680,773 filed Aug. 8, 2012, the contents of which are hereby incorporated in their entirety.

BACKGROUND AND SUMMARY

This invention relates to the manufacture of improved fabrication members, in particular, the manufacturing of fabrication members having properties to create more effective and efficient fabrication members.

Frame members, or fabrication members, are made from a variety of materials used for many different applications. Structural frame members, a subset of fabrication members, are used in applications where increased load is exerted in the structure. Such loads in buildings may comprise the gravitational load exerted by the weight of the building, the loads exerted by the manner in which the building is used, and loads exerted by the environment, such as from wind and seismic activity. Such loads in vehicles may be exerted by the weight of the vehicle, by the cargo carried by the vehicle, or the manner in which the vehicle is used, additionally, such loads may be exerted by collisions. In each instance, the structure has to be reinforced, compared to non-load-bearing areas, in order to maintain the structural integrity of the building or vehicle.

It is customary for the designer of structures to specify the load-bearing qualities which must be exhibited, at least, by each of the components comprised in the structure. Special attention is paid to the special load-bearing components. Typically, these load-bearing components are formed from a single strip of raw material, having relatively uniform thickness and substantially uniform properties across the entire component. Examples of such members, as used in buildings, include cold-formed steel metal studs used in walls, metal building purlins used in roofs and walls, or curtainwall members or large windows. Such structures have been customarily made from a single piece of metal strip material which is cold-formed through a series of mechanical passes in order to shape the strip into the desired structure. As a result, the previous cold-formed structural frame or fabrication members have a relatively uniform thickness throughout the entire structure, including areas of the structure which are non-load-bearing. These previous structural frame members, therefore, comprise more material than is necessary to perform their desired function.

These fabrication members often comprise of a web portion and two flange portions and generally have a C-shape, U-shape, or Z-shape. C-shape, U-shape and Z-shape fabrication members generally comprise two load-bearing flange members and a web portion rigidly connecting the flange members together. The load-bearing flange members must conform to specified dimensions for a given function and a given material from which the structural frame members are made. The web portions of a C-shape, U-shape, or Z-shape structural fabrication member transfer load between the two flange portions, and carries load as a structural element of the structural fabrication member, such forces and loads are experienced when the fabrication member, or structural frame member, is used, for example, as a beam or a column in a building. When a C-shape, U-shape, or Z-shape structural frame member, or fabrication member is used as a wall stud, the structural fabrication member bears an axial load, where the vertical forces are born directly by the flange portions and web portions. When used as a beam, the web portions, of the structural fabrication member, bear the majority of the shear forces exerted on the fabrication member.

Web portions are designed to withstand torsional or shear loads, or different load than the flange portions of the structural fabrication members. Generally, these structural frame members are formed from a single metal strip, web having the same dimensions and mechanical properties as the load-bearing flanges, providing for a lot of redundant material in the web portions. There is, therefore, a need for a structural frame member meeting the desired load-bearing and functional requirements, while also having a more effective and efficient structure.

Presently disclosed is a method of making a composite fabrication member having a shape selected from the group consisting of C-shape, U-shape, or Z-shape. The method comprises the steps of providing in a coil a first planar member having a desired cross-sectional shape and a desired first set of mechanical properties suitable to form a first base of a composite fabrication member; providing in a coil a second planar member having a desired cross-sectional shape and a desired second set of mechanical properties different from the first planar member suitable to form a web of a composite fabrication member; providing in a coil a third planar member having a desired cross-sectional shape and a desired third set of mechanical properties suitable to form a second base of a composite fabrication member; uncoiling and passing through accumulators the first planar member, second planar member, and third planar member, the accumulators allowing sufficient delay to permit for welding of end portions of coils to enable continuous flow of first planar member, second planar member, and third planar member; aligning side portions of the first planar member and second planar member and side portions of the third planar member and second planar member for attachment, attaching the first planar member, second planar member and third planar member together at respective side portions by induction welding to form a composite intermediate product as a continuum of first, second, and third planar members. In some embodiments the method further comprises the step of cold-forming the composite intermediate product to form a composite structural fabrication member having a shape selected from the group consisting of C-shape, U-shape, or Z-shape, with the first and third planar members flanges and the second planar member a web of the composite structural fabrication member. The first, second, and third planar members may themselves be a composite of one or more planar members as desired.

Some embodiments, the present method may produce composite structural frame members of a desired cross-sectional shape at 300-500 ft/min, or up to 800 ft/min or more, dependent in part on the size and desired cross-section shape of the structural fabrication member. In other embodiments, the present method may produce composite intermediate product at more than 200 ft/min. The bend formed in the C-shape, U-shape, or Z-shape, by cold-forming, or otherwise, may be situated in the flanges or the web as desired.

In some embodiments, the thickness of the second planar member or members is less than the thickness of the first and third planar members. The second planar member may be selected to provide a lightweight web for the composite structural fabrication member while providing a composite fabrication member with equal or greater load bearing specifications. In such embodiments, the second planar member may form the web between the first and third planar members which provide the load-bearing flanges for the composite structural fabrication member. The second planar member forming the web may be selected to have a reduced amount of material and meet a desired specification and shape. The composite structural fabrication member having a web portion may be configured to have a reduced amount of material and meet a desired set of specifications for a given desired shape and provide a more effective and efficient structural component. The composite structural fabrication members therefore having a reduced cost in starting materials and reduced weight, reducing associated transportation costs of raw materials, intermediary products, and finished products. Composite components formed by the present method are lighter, reducing the weight of the vehicles, reducing manufacturing expenses, and increasing fuel efficiency in operation of the vehicles. It is contemplated that the presently disclosed method may be utilized to make non-structural elements of vehicles and building as well.

In some embodiments, a lip may be formed on the first or third planar members to form a composite lipped C-shaped member, or composite lipped U-shaped member, or composite lipped Z-shape member, of the first, second, and third planar members. The first and/or third planar members may have side portions overlapping with side portions of the second planar member prior to the step of attaching by induction welding. In some embodiments, the welds may be continuous welds. In other embodiments, the welds may be discrete welds, making welding joints at discrete intervals along respective side portions and between the second planar member and the first and third planar members, respectively.

Each of the planar members comprising the composite intermediate product may have the same or different mechanical properties. In some embodiments, the first and third planar members may have the same mechanical properties, forming a composite structural fabrication member with flanges providing similar load-bearing and structural properties. Alternatively, the first and third planar members may have different mechanical properties, for applications where the load-bearing performed and structural properties required by the first planar member may be different from the load-bearing performed and structural properties required by the third planar member. This provides for flexibility in providing composite fabrication members, formed from the composite intermediate product, for a wide range of applications. Furthermore, the composition of the material used in the first, second, and third planar members may be different from each other, or, alternatively, the first, second, and third planar member may be made from material having the same composition. In particular, the first and third planar members may be formed from metal having a different composition to that of the second planar member.

The step of providing as coils first and third planar members may include selecting the first and third planar members to have mechanical properties to provide the desired load-bearing capacity and structural properties for the composite structural fabrication member, while reducing the amount of material used to form the composite structural member. Also, the step of providing as a coil the second planar member may include selecting the second planar member to have mechanical properties reducing the amount of material used to form the composite structural fabrication member, while providing desired mechanical properties of the composite structural fabrication member.

In some embodiments, the step of attaching the first, second, and third planar members into a composite intermediate product as a continuum of first, second, and third planar members may be performed with the step of cold-forming the composite intermediate product to form a composite structural fabrication member having a shape selected from the group consisting of C-shape, lipped C-shape, U-shape, lipped U-shape, Z-shape, or lipped Z-shape.

Also disclosed is a method of making a composite intermediate product comprising the steps of: providing as a coil a first planar member having a desired cross-sectional shape and a desired first set of mechanical properties suitable to form a first base of a composite fabrication member having a desired cross-sectional shape; providing as a coil a second planar member having a desired cross-sectional shape and a desired second set of mechanical properties different from the first planar member suitable to form a web of a composite fabrication member; providing as a coil a third planar member having a desired cross-sectional shape and a desired third set of mechanical properties suitable to form a second base of a composite fabrication member having a desired cross-sectional shape; uncoiling and passing through accumulators the first planar member, second planar member, and third planar member, the accumulators allowing sufficient delay to permit for welding of end portions of coils to enable continuous flow of first planar member, second planar member and third planar member; aligning side portions of first planar member and second planar member and side portions of third planar member and second planar member for attachment; and, attaching the first planar member, second planar member, and third planar member together at respective side portions by induction welding to form a composite intermediate product as a continuum of first, second, and third planar members.

In some embodiments, the present method may produce composite intermediate product of a desired cross-sectional shape at 300-500 ft/min, or up to 800 ft/min or more, dependent in part on the size and desired cross-section shape of the composite intermediate product. In other embodiments, the present method may produce composite intermediate product at more than 200 ft/min.

Presently disclosed is a system for forming a composite intermediate product by the herein disclosed methods. Additionally, presently disclosed is a system for forming a composite fabrication member by the herein disclosed methods.

The presently disclosed methods may comprise a further step of coiling the composite intermediate product for transporting. The coil of composite intermediate product may be transported to a cold-forming mill, stamping facility, and/or press-molding facility, or to other facilities, for further processing of the composite intermediate product.

The composite intermediate product may be adapted to be cold-formed in a cold-forming mill to make a composite fabrication member for buildings, vehicles and other applications. Such composite fabrication members may take the form of any suitable such, for example, C-shape, U-shape, Z-shape, or lipped versions thereof.

The composite intermediate product and subsequent cold-formed structural fabrication member may be desirable in a number of industries. Such industries may include, but not be limited to, the building, automotive, piping, plumbing, gutter, mechanical, and oil & gas industries.

DETAILED DESCRIPTION OF THE DRAWINGS

Figure 1:
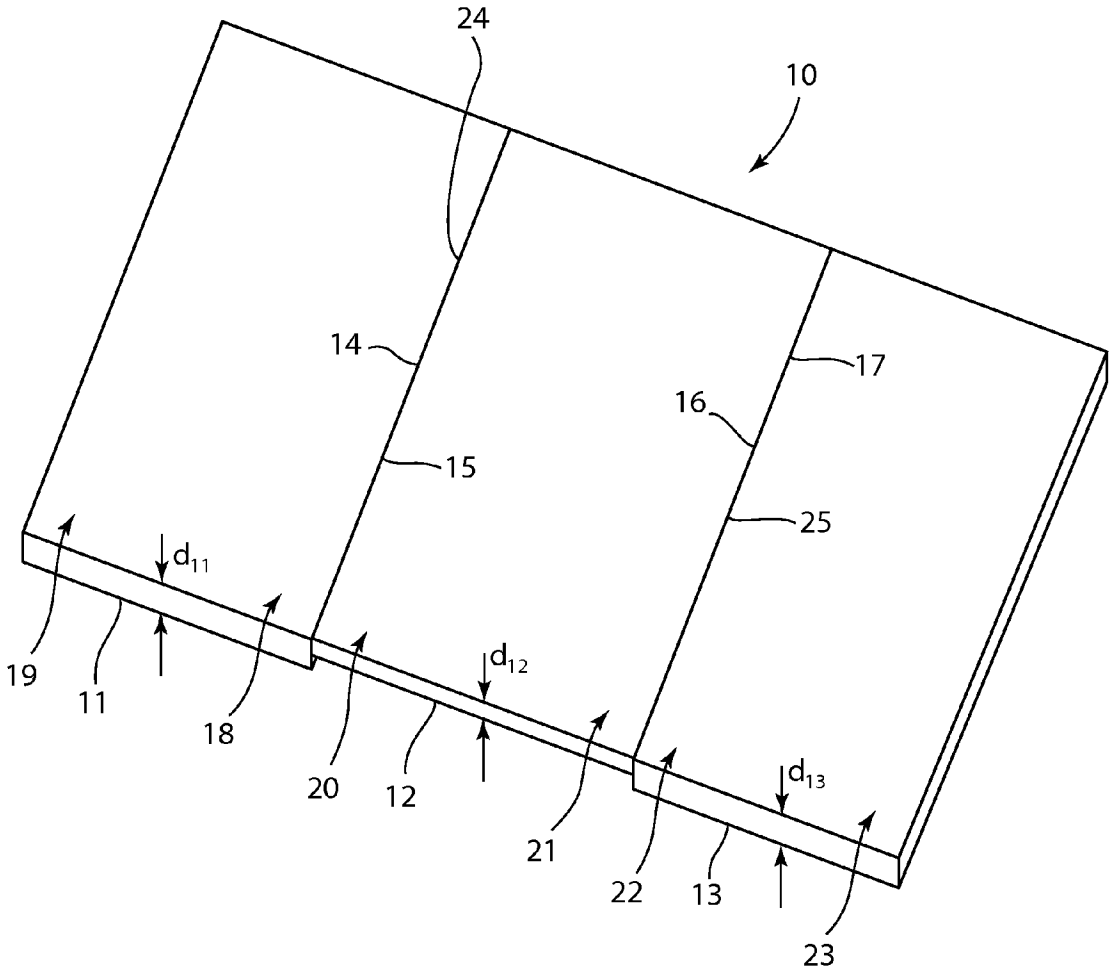
FIG. 1 is a perspective view of a composite intermediate product, a continuum of first, second, and third planar members.

Referring to FIG. 1. Illustrated is a first planar member 11, second planar member 12, and third planar member 13. The first planar member 11 is provided having a desired cross-sectional shape and desired first set of mechanical properties suitable to form a first base of a composite structural fabrication member (see FIG. 2), having been uncoiled. The second planar member 12 is provided adjacent the first planar member 11, the first side 15 of the second planar member 12 abutting the first side 15 of the first planar member 11, the second planar member having been uncoiled. As used herein, adjacent includes touching and overlapping. For example a first planar member adjacent a second planar member includes the first and second planar members touching at side portions, and overlapping at side portions.

In alternative embodiments, the first side 15 of the second planar member 12 may extend over or under the first side 14 of the first planar member 11, such that the first side portion 18 of the first planar member 11 overlaps with the first side portion 20 of the second planar member 12. The second planar member 12 may be selected as desired, suitable to form a web (see FIG. 2) of a composite structural frame member, the second planar member 12 having a desired cross-sectional shape and a desired second set of properties. The third planar member 13 is provided adjacent the second planar member 12, the first side 17 of the third planar member 13 abutting the second side 16 of second planar member 12, the third planar member having been uncoiled. In alternative embodiments, the second side 16 of the second planar member 12 may extend over or under the first side 17 of the third planar member 13, such that the first side portion 22 of the third planar member 13 overlaps with the second side portion 21 of the second planar member 12. The third planar member 13 may be selected suitable to form a second base of a composite fabrication member (see FIG. 2) having a desired cross-sectional shape, such that the shape of the composite fabrication member is selected from the group of C-shape, lipped C-shape, U-shape, lipped U-shape, Z-shape, or lipped Z-shape. The third planar member 13 is selected having a desired cross-sectional shape and a desired third set of mechanical properties. The mechanical properties of the third planar member 13 may be the same as the mechanical properties of the first planar member 11. Alternatively, the mechanical properties of the third planar member 13 may be the same as mechanical properties of the second planar member 12. In further embodiments, the mechanical properties of each planar member may be different.

Planar members as described herein may be any suitable flat or curvilinear sheet of a desired cross-section. Each planar member may be made from a suitable material such as metal sheet or strip, such as steel, aluminum, other metal alloys, or composite metal structures. The planar members may be provided as coils to be uncoiled and processed into composite intermediate products. Furthermore, each planar member provided in coils formed from metal sheet may have a variety of coatings, such as coatings permissible by Table 1 of ASTM A1003/A1003M—12 Standard Specification for Steel Sheet, Carbon, Metallic and Nonmetallic Coated for Cold Formed Framing Members. The first planar member 11 may have a thickness $d_{11}$, the third planar member 13 may have a thickness $d_{13}$ the same or different than the thickness $d_{11}$. The second planar member 12 may have a thickness $d_{12}$ less than the thickness $d_{11}$ and/or less than the thickness $d_{13}$, suitable for forming a web portion of a composite fabrication member (see FIG. 2) with a web thinner than the flanges and providing a composite fabrication member having a lightweight web. Alternatively, the thickness $d_{12}$ may be the same as the thickness $d_{11}$ and/or the thickness $d_{13}$.

The first planar member 11 and the third planar member 13 may be attached to the second planar member 12 at respective side portions by induction welding to form composite intermediate product 10 as a continuum of first, second, and third planar members. The welding used to make the composite intermediate product 10, may be continuous induction welding. Alternatively, such welding may be discrete induction welding forming welds at discrete intervals along the length of the side portions of the planar members at the weld sites 24, 25. Induction welding is where a conductive material (metal) passes through an electromagnetic field producing localized currents which heat the 2 edges of material through resistance and hysteresis to the point at which they can be fused. The electromagnetic field can be produced by passing an electrical current through a coil of conductive material or by inducing currents though contacts contact applied to the 2 material edges. As used herein, "induction welding," as used herein, may also include high frequency contact welding where weld current is transferred to the formed steel through contacts that ride on the strip. In high frequency contact welding the welding current is applied directly to a workpiece, such as a tube.

After forming the composite intermediate product 10, the welds along weld sites 26, 27, 28, and 29 may undergo a post-welding coating process whereby a coating, permissible by various ASTM standards, may be applied to the weld site to protect the weld from corrosion. Such process may be referred to as "metallizing welds."

In some embodiments, the planar members may be butt-welded. In other embodiments, the first side 14 of the first planar member 11 may extend over and beyond the first side 15 of the second planar member 12, such that the first side portion 18 of the first planar member 11 overlaps with the first side portion 20 of the second planar member 12, forming a first weld site 24. Similarly, the first side 17 of the third planar member 13 may extend over and beyond the second side 16 of the second planar member 12, such that the first side portion 22 of the third planar member overlaps with the second side portion 21 of the second planar member 12, forming a second weld site 25.

The resulting composite intermediate product 10 as a continuum of first, second, and third planar members, is a continuous component of one or more materials having one or more compositions, usually metal, with welding at the weld sites 24, 25 attaching the first planar member 11 and the third planar member 13 with the second planar member 12 to form an intermediate product having a contiguous cross-section formed from the three planar members. The composite intermediate product 10 as a continuum of the first, second, and third planar members is an intermediate product having different cross-sectional thicknesses, $d_{11}$, $d_{12}$, $d_{13}$, across its width, with transition portions between the different cross-sectional thicknesses.

The composite intermediate product 10 as a continuum of the first, second, and third planar members may have one surface on a contiguous plane. For example, the second planar member 12, having a thickness $d_{12}$ less than the thickness $d_{11}$ of the first planar member 11, may be positioned such that the top surface 27 of the second planar member 12 is flush with the top surface 26 of the first planar member 11. Similarly, the second planar member 12, having a thickness $d_{12}$ less than the thickness $d_{13}$ of the third planar member 13, may be positioned such that the top surface 27 of the second planar member 12 is flush with the top surface 28 of the third planar surface 13. The formed composite intermediate product 10, a continuum of the first, second, and third planar members, may have a flat, planar, top surface, and a stepwise bottom surface, the bottom surface of the second planar member recessed relative to the bottom surface of the first and third planar members.

Alternatively, the second planar member 12, may be positioned at any position along the thickness $d_{11}$ of the first planar member 11, or the thickness $d_{13}$ of the third planar member 13, or both. The positions of the first and third planar members may be the same relative to the second planar member, or, alternatively, the position of the third planar member may be off-set from the first-planar member. Both the top and bottom surfaces of the composite intermediate product 10 may be stepwise.

In any case, the second planar member 12 may be selected to provide a desired lightweight web member for the composite fabrication member 29 having a shape selected from C-shape, lipped C-shape, U-shape, lipped U-shape, Z-shape or lipped Z-shape. The first and third planar members, 11 and 13, respectively, may be selected to have different compositions and mechanical properties. The first planar member 11 and the third planar member 13 will usually have the same mechanical properties, but applications may require that the first and third planar members may be of different compositions and mechanical properties, for example where one flange portion of the composite fabrication member has desired load-bearing properties lateral to load-bearing properties of the other flange portions and web portions. The first planar members 11 and the third planar members 13, the flanges, will usually have different mechanical properties from the second planar member 12, the web, usually the web portion carrying torsional and shear forces between along its length and between flange portions. While the mechanical properties of the first and third planar members may differ from the mechanical properties of the second planar member, the planar members may be of the same composition. Alternatively, the composition of the second planar member 12, the web portion, having different load-bearing properties than the flange portions of the composite fabrication member, may be different from the other planar members.

The composite intermediate product 10 formed as a continuum of the first, second, and third planar members, having different thicknesses $d_{11}$, $d_{12}$, and $d_{13}$ across its width, may be coiled by a coiler (see FIG. 3) and transported as an intermediate product to a separate forming facility for forming into a composite fabrication members. Such facility may be a cold-forming facility such as that shown in FIG. 6, and discussed below. Alternatively, such facilities may be a hot-rolling facility, where the facility heats the strip, comprising the composite intermediate product 10, and hot-rolls the strip to a desired cross-sectional shape. Desired cross-sectional shapes which may be formed include C-shape, lipped C-shape, U-Shape, lipped U-shape, Z-shape, and lipped Z-shape composite fabrication members.

In alternative embodiments, the composite intermediate product 10, as a continuum of the first, second, and third planar members, having different thicknesses $d_{11}$, $d_{12}$, and $d_{13}$, across its width, may be cold-formed with the step of induction welding the first, second, and third planar members together to form a composite fabrication member having a shape selected from the group consisting of C-shape, lipped C-shape, U-shape, lipped U-shape, Z-shape, or lipped Z-shape.

Figure 2A:
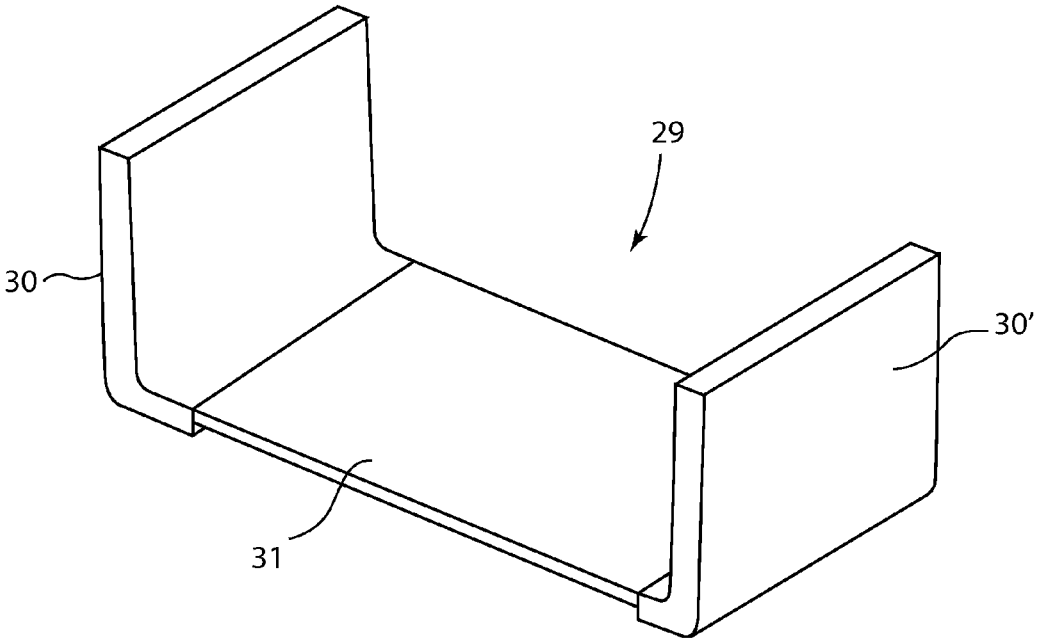
FIG. 2*a* is a perspective view of a U-shaped fabrication member formed in accordance with the presently disclosed methods of making a fabrication member having a shape selected from the group consisting of C-shape, U-shape, or Z-shape.
Figure 2B:
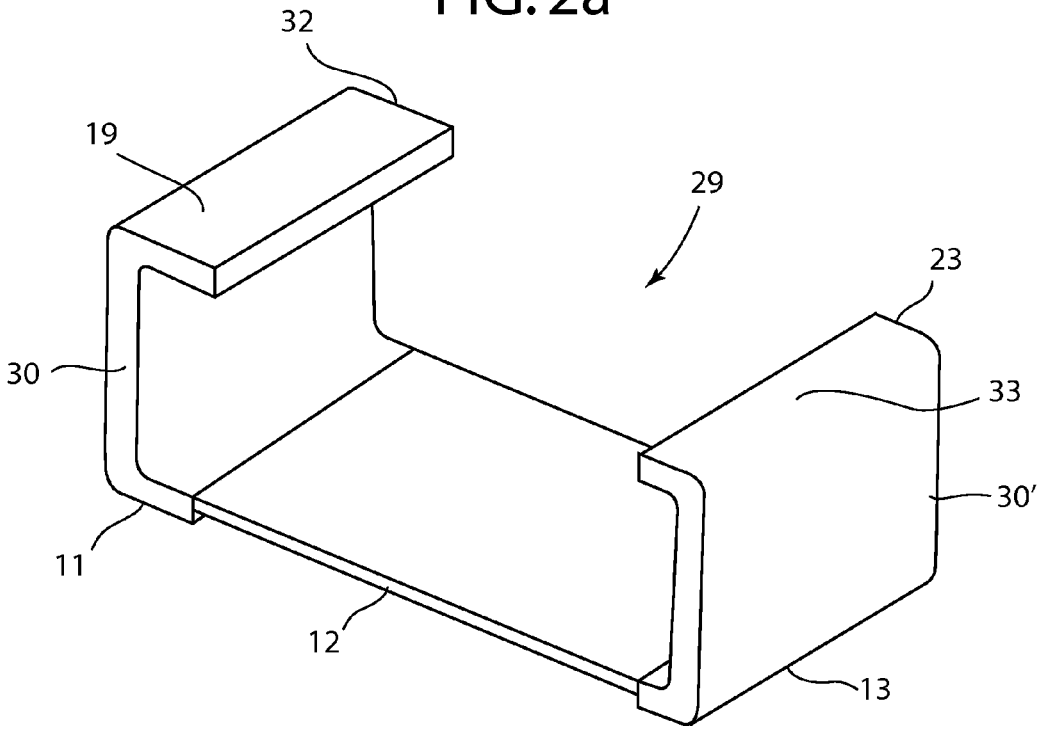
FIG. 2*b* is a perspective view of a lipped U-shaped fabrication member formed in accordance with the presently disclosed methods of making a fabrication member having a shape selected from the group consisting of lipped C-shape, lipped U-shape, or lipped Z-shape.

Referring now to FIG. 2*a*, illustrated is a composite fabrication member 29 formed by cold-forming the composite intermediate product 10, a continuum of the first, second, and third planar members (see FIG. 1), to form a composite fabrication member 29 having a shape selected from the group consisting of C-shape, lipped C-shape, U-shape, lipped U-shape, Z-shape, or lipped Z-shape, where the first planar member 11 is a flange 30, and the third planar member 13 of a second flange 30', of the composite fabrication member 29 having a desired shape. In illustration, the embodiment in FIG. 2*a* is a composite fabrication member 29 having a U-shape. FIG. 2*b* illustrates an alternative embodiment of the composite fabrication member 29, where a lip 32 is formed at a second side portion 19 of the first planar member 11, and a second lip 33 is formed at a second side portion 23 of the third planar member 13, to form a lipped C-shaped member of the first planar member 11, the second planar member 12, and the third planar member 13. Similar lips may be formed into the second side portions of the first and third planar members of composite intermediate product 10, a continuum of the first, second, and third planar members, while cold forming to form lipped C-shape, from C-shape composite structural member, lipped U-shape, from U-shape composite structural member, and lipped Z-shape, from Z-shape fabrication member composite structural member.

The first planar members 11, second planar members 12, and the third planar members 13, may be selected to have properties for providing a more effective and efficient amount of material used to form the lipped composite structural member 29, while providing desired mechanical properties of the lipped composite structural member 29. The first planar members 11, second planar members 12, and third planar members 13, may each be provided in coils, adapted to be uncoiled, passed through accumulators, the accumulators allowing sufficient delay to permit for induction welding of end portions of coils to enable continuous flow of first planar member, second planar member, and third planar member, and then aligned at respective side portions for attaching.

Figure 3:
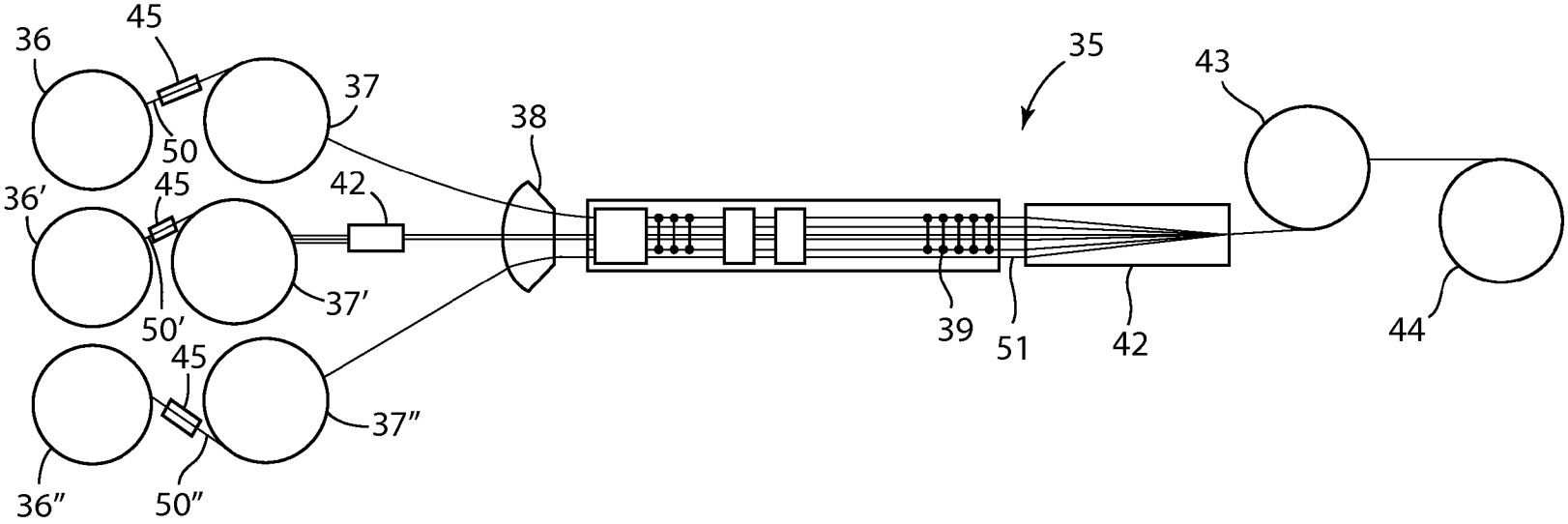
FIG. 3 is a schematic view of a continuous welding apparatus for welding the selected first, second, and third planar members to form a composite intermediate product, a continuum of first, second, and third planar members.

Referring to FIG. 3, illustrated is a schematic of a continuous welding apparatus 35 for attaching the selected first, second, and third planar members at respective side portions by induction welding to form a composite intermediate product 10. The continuous welding apparatus 35 comprises a strip loader 36 for uncoiling coils of each planar member required to make a composite fabrication member having a desired cross-sectional shape. Shown is an exemplary continuous welding apparatus 35, having three individual strip loaders 36, 36', and 36", adapted to uncoil three coils of strip 50, 50', and 50", each strip comprising of first, second, and third planar members, respectively. In operation, the loaders 36, 36', 36" uncoil their respective coils of strip, with each strip, 50, 50', 50", being transported to an individual accumulator 37, 37', 37" adapted to accumulate a large amount of strip to allow sufficient delay to permit for cutting and welding end portions of coils of strip to enable continuous flow of first planar member, second planar member, and third planar member, eliminating the need to continually shutdown and restart the continuous welding apparatus 35 each time a new coil of strip is required. Between each strip loader 36 and accumulator 37 there may be a strip leveler 45 adapted to selectively position the strip exiting each strip loader 36 before entering the accumulator 37.

Each accumulator 37, 37', and 37", delivers the respective strip, 50, 50', 50", to a strip aligner 38, the strip aligner 38 is adapted to position each strip, such that the first planar member 11, second planar member 12, and third planar member 13 are located in the desired positions for attaching together at respective side portions by welding by the forming and weld mill 39. The strip aligner 38 for aligning side portions 18 of the first planar member 11 with side portions 20 of the second planar member 12 and also side portions 22 of the third planar member 13 with side portions 21 of second planar member 12 for attachment. The strip aligner 38 may be adapted to be configured to change the locations in which it positions the individual planar members to achieve different desired composite intermediate products 10. Furthermore, the strip aligner 38 may be adapted to be configured while in use, so that a single composite strip, comprising a composite intermediate product as a continuum of first, second, and third planar members, having varying properties may be achieved.

The strip aligner 38 delivers the aligned planar members, 11, 12, and 13, to the forming and weld mill 39. A strip deflector 42 may be positioned upstream from the strip aligner 38 adapted to longitudinally rotate the strip, and/or change the elevation of the strip to a desired position, to orient the strip for welding. In some embodiments, the strip deflector 42 of the strip 50' comprising the second planar member 12 may be positioned upstream of the strip aligner 38, while the strip deflector 42 for the strip 50' and 50", comprising the first planar member 11 and the third planar member 13, respectively, may be integrated with the strip aligner 38, or positioned downstream of the strip aligner 38.

The forming and weld mill 39 may comprise a pair of set rollers 46 adapted to impart a tension onto each strip 50, 50', 50", to impart a desired tension into each individual strip in preparation for welding. In some embodiments, there may be one pair of set rollers 46 adapted to impart a tension into all strips 50, simultaneously. In other embodiments, there may be one set of set rollers 46 for each strip 50, adapted to impart a desired individual tension onto the strip 50. The forming and welding mill 39 comprises one or more induction welding stations 40, 41. As depicted in FIG. 3, the first welding station 40 is adapted to weld the first planar member 11 to the second planar member 12 at respective side portions along the length of the planar members. The second welding station 41 is adapted to weld the third planar member 13 to the opposite edge of the second planar member 12 to form a composite intermediate product 10, a continuum of first, second, and third planar members, at respective side portions, forming a composite strip 51 comprising the composite intermediate product 10. The welding stations 40, 41, may be positioned apart, one downstream from the other, as depicted in FIG. 3, or they may be positioned adjacent to one another, such that first planar member 11 and the third planar member 13 are welded to the second planar member 12 simultaneously.

The forming and weld mill 39 may be adapted to form the composite intermediate product 10 at a rate of 300 to 800 ft/min. In other embodiments the forming and weld mill 39 may be adapted to form the composite intermediate product 10 at speeds in excess of 200, 800 or 1,000 ft/min.

After the composite strip 51 exists the forming and weld mill 39, the strip may enter a strip deflector 42, adapted to rotate the strip to a desired orientation and/or change the elevation of the strip to a desired position, suitable for passing through an exit strip accumulator 43. An exit strip accumulator 43 may be positioned downstream of the forming and weld mill 39, adapted to accumulate a large amount of composite strip 51 such that a shear may cut lengths of strip for coiling, eliminating the requirement to continually shutdown and restart the continuous casting apparatus 35. After exiting the strip exit accumulator 43 the composite strip 51, comprising the composite intermediate product 10, a continuum of first, second, and third planar members, may be coiled into a coil of composite intermediate product at a strip coiler 44.

In other embodiments, the composite strip 51 may exit the forming and weld mill 39, and, optionally, an exit strip accumulator 43, and may directly enter a cold-forming mill (see FIG. 6) to be formed into a fabrication member having a desired cross-sectional shape, for example, C-shape, lipped C-shape, U-shape, lipped U-shape, Z-shape, or lipped Z-shape.

Figure 4:
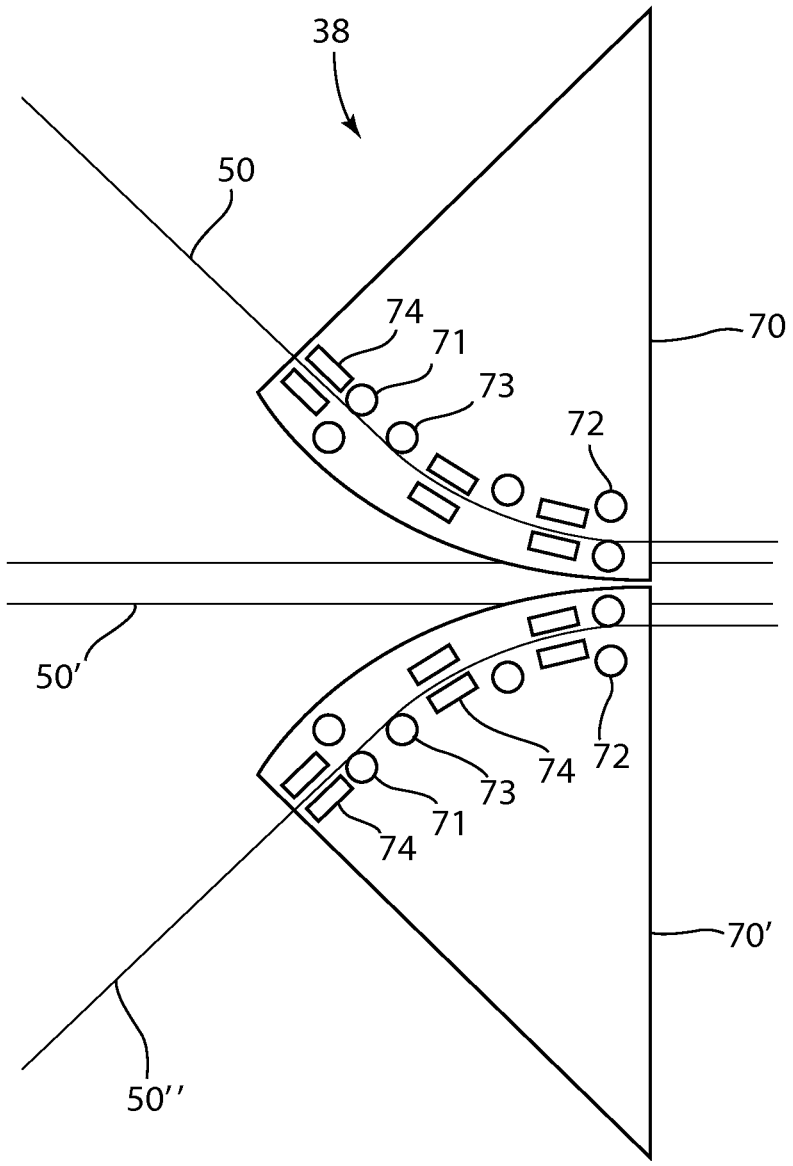
FIG. 4 is an enlarged schematic view of the strip alignment apparatus of the apparatus shown in FIG. 3.

Referring to FIG. 4, illustrated is an enlarged schematic view of the strip alignment apparatus 38. During operation, each strip 50, comprising a planar member, having a desired cross-section and a desired set of mechanical properties for forming into a fabrication member with a desired cross-sectional shape and specification, is guided to the strip alignment apparatus 38. The strip alignment apparatus 38, comprises an upper strip aligner 70 and a lower strip aligner 70'. The upper strip aligner 70' is adapted to align side portions of the upper, or first, strip 50, relative to side portions of the middle, or second strip, 50'. The lower strip aligner 70' is adapted to align side portions of the lower, or third, strip 50", relative to side portions of the middle, or second strip 50'. The strip aligner 38, may be adapted to both position the strips and also rotate the strips to orient the strips for attaching. Alternatively, as shown in FIG. 4, the strip aligner 38 may be adapted to selectively position the strips, with the rotation of the strip being performed downstream at the forming and weld mill 39.

Each of the upper strip aligners 70, and lower strip aligners 70', comprises a guide block 73 and a pair of entry rollers 71, respectively, at the entrance to the strip aligners. The guide block 74 and pair of entry rollers 71 adapted to receive the strip 50 and 50". The strip aligners 70 and 70' each have a plurality of guide rolls 73 and guide blocks 74, adapted to guide the strip 50 and 50" around the curve formed by the strip aligners 70 and 70', bringing the strip 50 and 50" in alignment with the strip 50' comprised of the second planar member 12.

Figure 5:
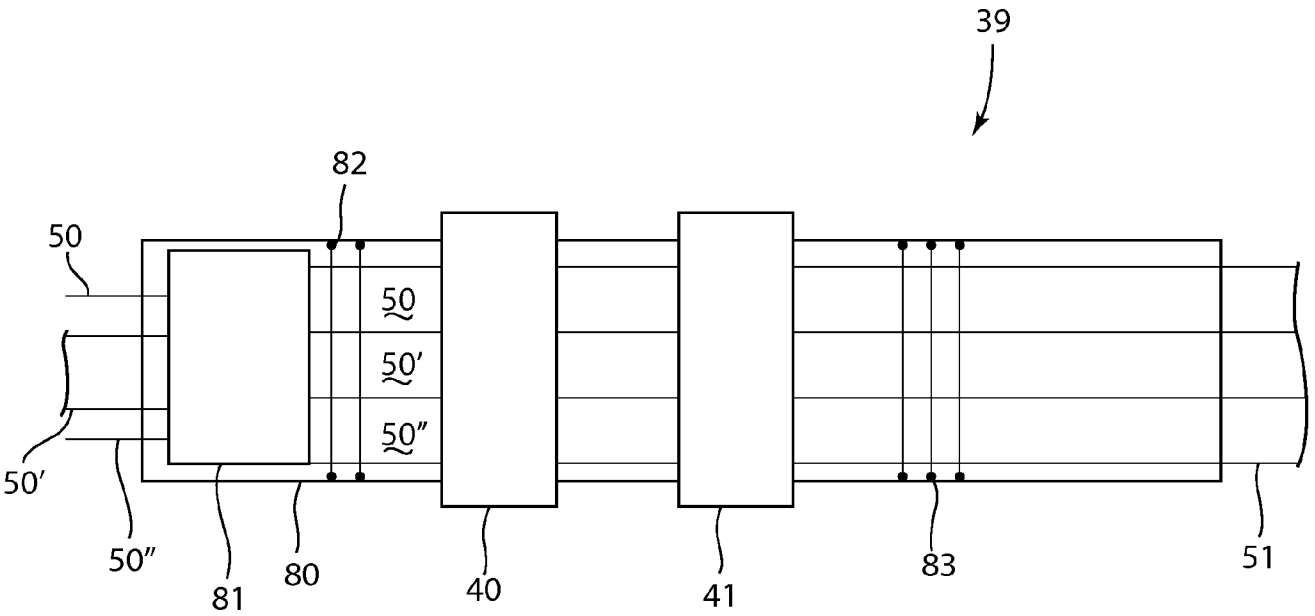
FIG. 5 is an enlarged schematic view of the welding apparatus of the apparatus shown in FIG. 3.

Referring to FIG. 5, illustrated is an enlarged schematic view of the forming and weld apparatus 39. The forming and weld apparatus 39 may a welding table or bench 80 adapted to support the elements of the forming and weld apparatus 39. In operation, the individual strip, 50, 50', and 50", comprised of first planar member 11, second planar member 12, and third planar member 13, respectively, exits the strip aligner 38 and enters the forming and weld mill 39. The strip 50, and 50", comprised of first and third planar members, respectively, may be orientated at a different angle compared to the orientation of the strip 50', comprised of second planar members 14. In such embodiments as shown, the strip 50, and 50', enter a strip deformer 81 adapted to longitudinally rotate the strip 50, and 50", to a desired orientation for welding to respective side portions of the strip 50', comprised of second planar members 12.

Sensors 82, may be located downstream of the strip deformer 81 adapted to measure the positions of the strip 50, 50', 50". The sensors 82 may be connected to a computer (not shown) adapted to analyze the data produced by the sensors to determine the positions of the strip 50, 50', and 50", and also actively control the function of the strip aligner 38 and the strip deflector 39 to ensure correct positioning of the strip 50, 50', and 50" for welding. The strip 50, 50', and 50", pass through the first induction welding station 40, adapted to attach side portions of the upper strip 50 to the middle strip 50' by induction welding, thereby welding the first side portion 18 of the first planar member 11 to the first side portion 20 of the second planar member 12. Subsequently, the combined strip, comprised of the attached first and second planar members, and the unattached strip 50" comprised of the third planar member, pass through the second induction welding station 41. The second induction welding station adapted to attach the third strip 50" to the second strip 50', thereby attaching the first side portion 22 of the third planar member 13 to the second side portion 21 of the second planar member by induction welding, to form composite strip 51, comprised of composite intermediate product 10 as a continuum of the first, second, and third planar members. In some embodiments, the forming and weld apparatus 39 may be adapted to weld respective side portions of strip at a rate of 300 to 800 ft/min. In other embodiments, the forming and weld apparatus 39 may be adapted to weld respective side portions of strip at a rate of, or in excess of, 200, 800, or 1,000 ft/min.

Figure 6:
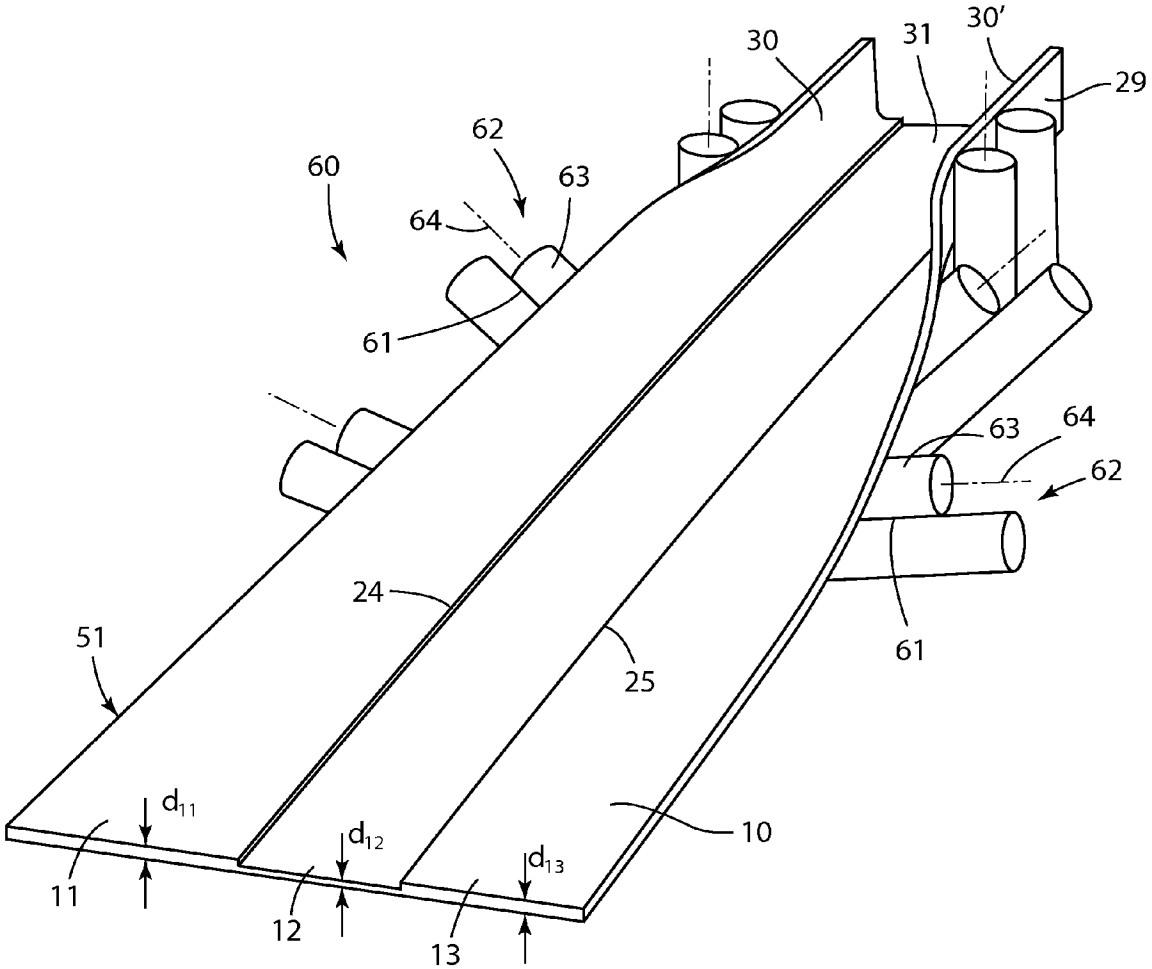
FIG. 6 is a perspective view of a cold forming apparatus for cold forming the composite intermediate product to form a fabrication member having a shape selected from the group of C-Shape, lipped C-shape, U-shape, lipped U-shape, Z-shape, or lipped Z-shape.

FIG. 6 illustrates a perspective view of a cold forming mill 60 for cold forming the composite strip 51, comprising composite intermediate product 10, to form a fabrication member 29 having a desired shape. The composite strip 51 may be cold-rolled immediately subsequent to the formation of the composite strip 51, comprising the composite intermediate product 10, being a continuum of the first, second, and third planar members. Alternatively, the composite strip 51 may be coiled by a coiler (see FIG. 3) and transported to a cold-forming mill for forming into composite fabrication members. It is contemplated that composite strip 51, comprising a composite intermediate product 10 formed from the presently disclosed methods, may be cold-rolled in existing cold-rolling mills with little to no modifications being made to the cold-rolling mill.

The cold forming apparatus 60 may comprise an entry guide (not shown) adapted to properly align the composite strip 51 as it passes through the roll sets 62 of the cold-forming rolling mill 60. The entry guide may be adapted to selectively position the composite strip 51, comprising a composite intermediate product 10, a continuum of first, second, and third planar members, 11, 12, and 13, such that the weld sites 24, 25 are desirably positioned relative to the roll sets 61. To ensure the composite fabrication member 29 meets the desired load-bearing specifications it may be necessary to position the incoming composite strip 51 such that the bend in the composite intermediate product 10 is positioned on the load-bearing flange members 30 and 30', as opposed to bending the web portion 31. Alternatively, it may be desirable to further reduce the material in the composite fabrication member 29 and position the composite strip 51 such that the bend in the composite intermediate product 10 is positioned on the non-load-bearing web portion 31, or at the join between the web portion 31 and the flange portions 30 and 30'.

The cold-rolling mill 60 may comprise multiple roll sets 61, each roll set comprising a work roll 62, having a rolling face 63, rotating about a work roll axle 64, and a driving roll 65, adjacent the work roll 62, adapted to rotate the work roll 62, and impart lubricating oil onto the rolling face 63 of the work roll 62. Each roll face 63 may be shaped to impart a desired cross-sectional shape onto the composite strip 51 to provide a composite fabrication member 29 having a desired cross-sectional shape of C-shape, U-shape or Z-shape, or of lipped C-shape, lipped U-shape, or lipped Z-shape. There may be successive roll sets 61, each roll set 61 adapted to further mold the composite strip 51 until the composite strip 51 has the desired cross-sectional shape. Furthermore, each consecutive roll set 61 may have work rolls 62 mounted on work roll axles 64 positioned at differing angles, such that each consecutive roll set 61 may impart an increased bend in the composite strip 51, relative to the previous roll set. Alternatively, a single roll set may be sufficient to mold the composite strip 51 into the desired cross-sectional shape.

In alternative embodiments, the roll sets may be positioned vertically, one roll positioned above the composite strip 51 and a second roll positioned oppositely below the composite strip 51. Each pair of rolls having a complimentary roll face. At each roll set there may be a second, side, roll set, having axles positioned perpendicular to the axles of the first roll set. The side roll set adapted to provide greater precision, flexibility, further support, and shaping of the composite strip, and to reduce stresses at the material. Furthermore, multiple cold-rolling mills may be utilized to provide a composite fabrication member having a desired cross-sectional shape.

The roll sets of the cold-rolling mill may have a roll face adapted to impart perforations, embossments, and knurling into the planar portions of the composite fabrication members. Alternatively, perforations may be formed by a stamping apparatus, adapted to make perforations of a desired shape and dimension in the web portions of flange portions of the composite fabrication member. Such stamping may be performed simultaneously with cold-forming, prior to cold-forming, or after cold-forming. Alternatively the planar members may be provided with perforations prior the step of attaching the planar members together at respective side portions to form a composite intermediate product. Similarly, embossments and knurling may be formed by a stamping apparatus before, during, or after cold-forming, or the planar members may be provided having desired knurling and embossments prior to the step of attaching the planar members together.

A composite fabrication member may be adapted for use as an interior dry-wall stud, having perforations of a desired shape and size at desired locations to functions as conduits for plumbing and electrics. Such perforations may form any shape, for example oval-shaped, circular-shaped, square-shaped, rectangular shaped or key-hole shaped. Embossments in the web member, for example, may be adapted to provide enhanced strength to the composite fabrication member, further allowing a reduction in the material used to form a composite fabrication member having a desired set of mechanical properties. Such embossments may be diamond shaped. Embossments, such as ribs, formed in the flange portions of the composite fabrication member may increase the torsional load carrying capabilities of the composite fabrication member, further providing avenues for increasing the efficiency and effectiveness of the composite fabrication member. The composite fabrication member may undergo planking to increase the torsional strength of the composite fabrication member. Knurling may be provided in the composite fabrication member to act as guide-holes for fasteners, adapted to guide fasteners to a desired location when being placed in the fabrication member, reducing the tendency for fasteners to slide and skip on the surface of the composite fabrication member during installation of the fastener.

The features of the composite fabrication member may be provided in the individual planar members prior to attaching the planar members together. Alternatively, the composite intermediate product may be passed through a stamping or forming mill to impart desired features in the composite intermediate product. Alternatively, the cold-rolling mill adapted to form the composite fabrication member may also be adapted to impart a desired set of features into the composite fabrication member while forming the composite fabrication member.

Shears may be provided upstream of the cold-rolling mill 60, between the cold-rolling mill, or downstream of the cold-rolling mill, adapted to cut the composite strip 51, or cold-formed composite strip 51, into desired discrete lengths to form composite fabrication members 29 having a desired cross-sectional shape.

While it has been described with reference to certain embodiments, it will be understood by those skilled in the art that various changes may be made and equivalents may be substituted without departing from scope. In addition, many modifications may be made to adapt a particular situation or material to the teachings without departing from its scope. Therefore, it is intended that it not be limited to the particular embodiments disclosed, but that it will include all embodiments falling within the scope of the appended claims.

What is claimed is:

1. A method of making a composite fabrication member adapted to be used in one of a building and a vehicle having a shape selected from the group consisting of C-shape, U-shape, or Z-shape comprising the steps of:

providing in a coil a first planar member having a desired cross-sectional shape and a desired first set of mechanical properties suitable to form a first base of a composite fabrication member for a building or vehicle;

providing in a coil a second planar member having a desired cross-sectional shape and a desired second set of mechanical properties different from the first planar member suitable to form a web of a composite fabrication member for a building or vehicle;

providing in a coil a third planar member having a desired cross-sectional shape and a desired third set of mechanical properties suitable to form a second base of a composite fabrication member for a building or vehicle;

uncoiling and passing through accumulators the first planar member, second planar member, and third planar member, the accumulators allowing sufficient delay to permit for welding of end portions of coils to enable continuous flow of first planar member, second planar member, and third planar member;

aligning side portions of the first planar member and second planar member and side portions of the second planar member and third planar member for attachment;

attaching the first planar member, second planar member, and third planar member together at respective side portions by welding to form a composite intermediate product as a continuum of first, second and third planar members; and, cold-forming the composite intermediate product to form a composite fabrication member for a building or vehicle having a shape selected from the group consisting of C-shape, U-shape, or Z-shape, with the first and third planar members flanges and the second planar member a web of the composite fabrication member for a building or vehicle having a shape selected from the group consisting of C-shape, U-shape, or Z-shape.

2. The method of making a composite fabrication member having a shape selected from the group consisting of C-shape, U-shape, or Z-shape as claimed in claim 1 where the shape selected in C-shape and where a lip is formed on at least the first and third planar members to form a lipped C-shaped member of the first, second, and third planar members.

3. The method of making a composite fabrication member having a shape selected from the group consisting of C-shape, U-shape, or Z-shape as claimed in claim 1 where the first and third planar members have side portions overlapping with side portions of the second planar member prior to the step of welding.

4. A method of making a composite fabrication member having a shape selected from the group consisting of C-shape, U-shape, or Z-shape as claimed in claim 1 where the thickness of the second planar member is less than the thickness of the first planar member.

5. The method of making a composite fabrication member having a shape selected from the group consisting of C-shape, U-shape, or Z-shape as claimed in claim 1 where the second planar member is selected to provide a lightweight web member of the composite fabrication member.

6. A method of making a composite fabrication member having a shape selected from the group consisting of C-shape, U-shape, or Z-shape as claimed in claim 1 where the first and third planar members have different mechanical properties.

7. A method of making a composite fabrication member having a shape selected from the group consisting of C-shape, U-shape, or Z-shape as claimed in claim 1 where the first and third planar members have the same mechanical properties.

8. A method of making a composite fabrication member having a shape selected from the group consisting of C-shape, U-shape, or Z-shape as claimed in claim 1 where the first and third planar members and the second planar member are formed from metal having different compositions.

9. A method of making a composite fabrication member having a shape selected from the group consisting of C-shape, U-shape, or Z-shape as claimed in claim 1 where the welds are continuous welds.

10. A method of making a composite fabrication member having a shape selected from the group consisting of C-shape, U-shape, or Z-shape as claimed in claim 1 where the welds are discrete welds.

11. A method of making a composite fabrication member having a shape selected from the group consisting of C-shape, U-shape, or Z-shape as claimed in claim 1 where the step of attaching the first, second, and third planar members into a composite intermediate product as a continuum of first, second, and third planar members is performed with the step of cold-forming the composite intermediate product to form a composite fabrication member having a shape selected from the group consisting of C-shape, lipped C-shape, U-shape, lipped U-shape, Z-shape or lipped Z-shape.

12. A method of making a composite intermediate fabrication product adapted to be used in one of a building and a vehicle comprising the steps of:

providing in a coil a first planar member having a desired cross-sectional shape and a desired first set of mechanical properties suitable to form a first base of a composite intermediate fabrication product for a building or vehicle;

providing in a coil a second planar member having a desired cross-sectional shape and a desired second set of mechanical properties different from the first planar member suitable to form a web of the composite intermediate fabrication product for a building or vehicle;

providing in a coil a third planar member having a desired cross-sectional shape and a desired third set of mechanical properties suitable to form a second base of the composite intermediate fabrication product for a building or vehicle;

uncoiling and passing through accumulators the first planar member, second planar member, and third planar member, the accumulators allowing sufficient delay to permit for welding of end portions of coils to enable continuous flow of first planar member, second planar member, and third planar member;

aligning side portions of the first planar member and second planar member and side portions of the second planar member and third planar member for attachment;

attaching the first planar member, second planar member, and third planar member together at respective side portions by welding to form a composite intermediate fabrication product for a building or vehicle as a continuum of first, second, and third planar members.

13. The method of making a composite intermediate fabrication product as claimed in claim 12 where the first and third planar members have side portions overlapping with side portions of the second planar member prior to the step of welding.

14. The method of making a composite intermediate fabrication product as claimed in claim 12 where the thickness of the second planar member is less than the thickness of the first planar member.

15. The method of making a composite intermediate fabrication product as claimed in claim 12 where the second planar member is selected to provide a lightweight web member of the composite intermediate fabrication product.

16. The method of making a composite intermediate fabrication product as claimed in claim 12 where the first and third planar members have different mechanical properties.

17. The method of making a composite intermediate fabrication as claimed in claim 12 where the first and third planar members have the same mechanical properties.

18. The method of making a composite intermediate fabrication product as claimed in claim 12 where the first and third planar members and the second planar member are formed from metal having different compositions.

19. The method of making a composite intermediate fabrication product as claimed in claim 12 where the welds are continuous welds.

20. The method of making a composite intermediate fabrication product as claimed in claim 12 where the welds are discrete welds.

21. The method of making a composite intermediate fabrication product as claimed in claim 12 where the composite intermediate product is adapted to be cold-formed in a cold-forming mill to form a composite fabrication member.

* * * * *